US010392227B2

(12) United States Patent
Convard et al.

(10) Patent No.: US 10,392,227 B2
(45) Date of Patent: Aug. 27, 2019

(54) ELEVATOR SYSTEM MAINTENANCE FROM INSIDE A CAR OF THE ELEVATOR SYSTEM

(71) Applicant: Otis Elevator Company, Farmington, CT (US)

(72) Inventors: Emmanuel Convard, Gien (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 271 days.

(21) Appl. No.: 15/327,711

(22) PCT Filed: Jul. 25, 2014

(86) PCT No.: PCT/IB2014/001708

§ 371 (c)(1),
(2) Date: Jan. 20, 2017

(87) PCT Pub. No.: WO2016/012828

PCT Pub. Date: Jan. 28, 2016

(65) Prior Publication Data

US 2017/0210599 A1 Jul. 27, 2017

(51) Int. Cl.

| | |
|---|---|
| ***B66B 11/02*** | (2006.01) |
| ***B66B 5/00*** | (2006.01) |
| ***B66B 9/00*** | (2006.01) |

(52) U.S. Cl.

CPC ..... *B66B 11/0246* (2013.01); *B66B 5/0087* (2013.01); *B66B 9/00* (2013.01)

(58) Field of Classification Search

CPC ..... B66B 11/0246; B66B 5/0087; B66B 9/00
See application file for complete search history.

(56) References Cited

U.S. PATENT DOCUMENTS 5,971,109 A 10/1999 Aulanko et al.
6,419,052 B1 * 7/2002 Muller ..... B66B 11/0246 187/414

(Continued)

FOREIGN PATENT DOCUMENTS

CN 1585723 A 2/2005
EP 2727875 A1 5/2014

(Continued)

OTHER PUBLICATIONS

Machine translation of JP2011068428 (Year: 2018).*

(Continued)

*Primary Examiner* — Michael A Riegelman
(74) *Attorney, Agent, or Firm* — Cantor Colburn LLP

(57) ABSTRACT

An elevator car for an elevator system includes one or more elevator car walls and an access door openable from inside the elevator car to provide access to one or more elevator system components located outside of the elevator car. The access door is openable such that inspection, maintenance and/or repair is performed on the one or more elevator system components from inside of the elevator car. An elevator system includes a hoistway and one or more elevator system components fixed in the hoistway. An elevator car is suspended in the hoistway and is drivable along the hoistway. The elevator car includes an access door openable from inside the elevator car to provide access to the one or more elevator system components in the hoistway, such that inspection, maintenance and/or repair is performed on the one or more elevator system components from inside of the elevator car.

11 Claims, 5 Drawing Sheets

(56) References Cited

U.S. PATENT DOCUMENTS 6,691,833 B1* 2/2004 Elsener ..... B66B 11/0246 187/254
6,880,678 B1* 4/2005 Schneider ..... B66B 11/0246 187/314
9,193,566 B1* 11/2015 Nieves ..... B66B 11/0226
2003/0015378 A1* 1/2003 Elsener ..... B66B 5/0087 187/336
2005/0224299 A1* 10/2005 Soemardjan ..... B66B 11/0246 187/406
2006/0289244 A1* 12/2006 Sittler ..... B66B 11/0246 187/401
2010/0038183 A1* 2/2010 Henseler ..... B66B 11/0246 187/276
2010/0200339 A1* 8/2010 Henseler ..... B66B 5/005 187/401
2015/0246792 A1* 9/2015 Baltis ..... B66B 11/0246 187/276
2017/0210599 A1* 7/2017 Convard ..... B66B 11/0246
2017/0297870 A1* 10/2017 Fauconnet ..... B66B 11/0226
2018/0086604 A1* 3/2018 Fonteneau ..... B66B 11/0246
2018/0105394 A1* 4/2018 Hill ..... B66B 11/0226
2018/0105395 A1* 4/2018 Cortes ..... B66B 5/0087
2018/0201479 A1* 7/2018 Taudou ..... B66B 13/16
2018/0215580 A1* 8/2018 Convard ..... B66B 5/0087
2018/0222723 A1* 8/2018 Gressien ..... B66B 5/0087
2018/0229973 A1* 8/2018 Beauchaud ..... B66B 11/0226
2018/0327221 A1* 11/2018 Sudi ..... B66B 1/3492
2018/0339879 A1* 11/2018 Quaretti ..... B66B 3/008

FOREIGN PATENT DOCUMENTS

JP 2007091430 A 4/2007
JP 2011068428 A 4/2011
WO 0179104 A1 10/2001

OTHER PUBLICATIONS

Machine Translation of JP200791430 (Year: 2018).*
Notification of Transmittal of the International Search Report and the Written Opinion of the International Searching Authority, or the Declaration; Application No. PCT/IB2014/001708; dated Mar. 19, 2015; 10 pages.
Chinese Office Action Issued In CN Application No. 201480080930.0, dated Jul. 18, 2018, 8 Pages.

* cited by examiner

*- PRIOR ART -*

- PRIOR ART -

- PRIOR ART -

ELEVATOR SYSTEM MAINTENANCE FROM INSIDE A CAR OF THE ELEVATOR SYSTEM

CROSS REFERENCE TO RELATED APPLICATIONS

This National Stage application claims priority to PCT Patent Application No. PCT/IB2014/001708 filed Jul. 25, 2014, the entire contents of which is incorporated herein by reference.

BACKGROUND OF THE INVENTION

The subject matter disclosed herein relates to elevator systems. More particularly, the present disclosure relates to maintenance of elevator system components.

A typical elevator system includes an elevator car that moves along a hoistway. The elevator system also includes various systems, such as drive systems, electrical systems, governor and tensioning device, a machine that drives the elevator car along the hoistway, and lighting systems that are typically located in the hoistway.

The systems and components in the hoistway require periodic inspection, maintenance and/or repair. Such maintenance is typically performed by a technician entering the hoistway. Regulatory bodies have specified increases in safety volume and clearance for technicians entering the hoistway resulting in a larger overall volume of the elevator systems, while elevator system customers desire that the elevator system occupy a smaller overall volume.

BRIEF DESCRIPTION OF THE INVENTION

In one embodiment, an elevator car for an elevator system includes one or more elevator car walls and an access door openable from inside the elevator car to provide access to one or more elevator system components located outside of the elevator car. The access door is openable such that inspection, maintenance and/or repair can be performed on the one or more elevator system components from inside of the elevator car.

Alternatively or additionally, in this or other embodiments, the elevator car includes a sensor located at the elevator car. The sensor is operably connected to the access door to trigger opening of the access door when the elevator car is in proximity to the one or more elevator system components.

In another embodiment, an elevator system includes a hoistway and one or more elevator system components fixed in the hoistway. An elevator car is suspended in the hoistway via a suspension member and is drivable along the hoistway. The elevator car includes an access door openable from inside the elevator car to provide access to the one or more elevator system components in the hoistway, such that inspection, maintenance and/or repair can be performed on the one or more elevator system components from inside of the elevator car.

Alternatively or additionally, in this or other embodiments, the one or more elevator system components are located at one or more cabinets fixed at a sidewall of the hoistway.

Alternatively or additionally, in this or other embodiments, a telescoping mechanism is utilized to urge the elevator system component toward the elevator car.

Alternatively or additionally, in this or other embodiments, a sensor is located at the elevator car. The sensor is operably connected to the access door to trigger opening of the access door when the elevator car is in proximity to the one or more elevator system components.

Alternatively or additionally, in this or other embodiments, the one or more elevator system components includes a drive cabinet, an electrical cabinet, a lighting cabinet and/or a governor.

In yet another embodiment, a method of operating an elevator system includes driving an elevator car along a hoistway and stopping the elevator car in proximity to a first elevator system component located in the hoistway. A first access door of the elevator car from is opened from inside of the elevator car to access the first elevator system component disposed outside of the elevator car.

Alternatively or additionally, in this or other embodiments inspection, maintenance and/or repair of the first elevator system component is performed from inside of the elevator car.

Alternatively or additionally, in this or other embodiments the first elevator system component is urged toward the elevator car via a telescoping mechanism.

Alternatively or additionally, in this or other embodiments urging the first elevator system component toward the elevator car occurs automatically when the first access door is opened.

Alternatively or additionally, in this or other embodiments the telescoping mechanism is retracted to return the first elevator system component to its original position.

Alternatively or additionally, in this or other embodiments the retraction occurs automatically with closure of the first access door.

Alternatively or additionally, in this or other embodiments the elevator car is driven along the hoistway and is stopped in proximity to a second elevator system component. A second access door of the elevator car is opened from inside of the elevator car to access the second elevator system component disposed outside of the elevator car.

Alternatively or additionally, in this or other embodiments inspection, maintenance and/or repair of the second elevator system component is performed from inside of the elevator car.

The detailed description explains the invention, together with advantages and features, by way of examples with reference to the drawings.

DETAILED DESCRIPTION OF THE INVENTION

Figure 1A:
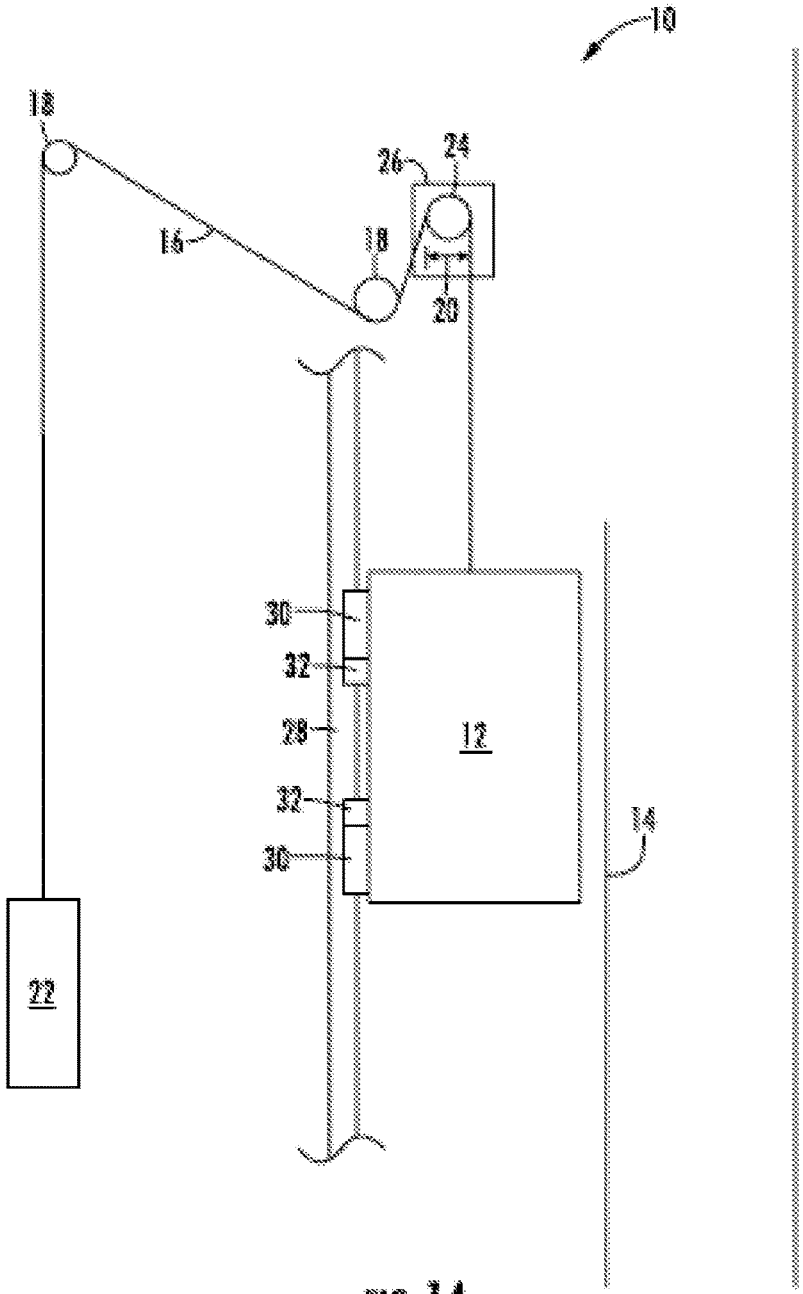
FIG. 1A is a schematic of an exemplary elevator system having a 1:1 roping arrangement.
Figure 1B:
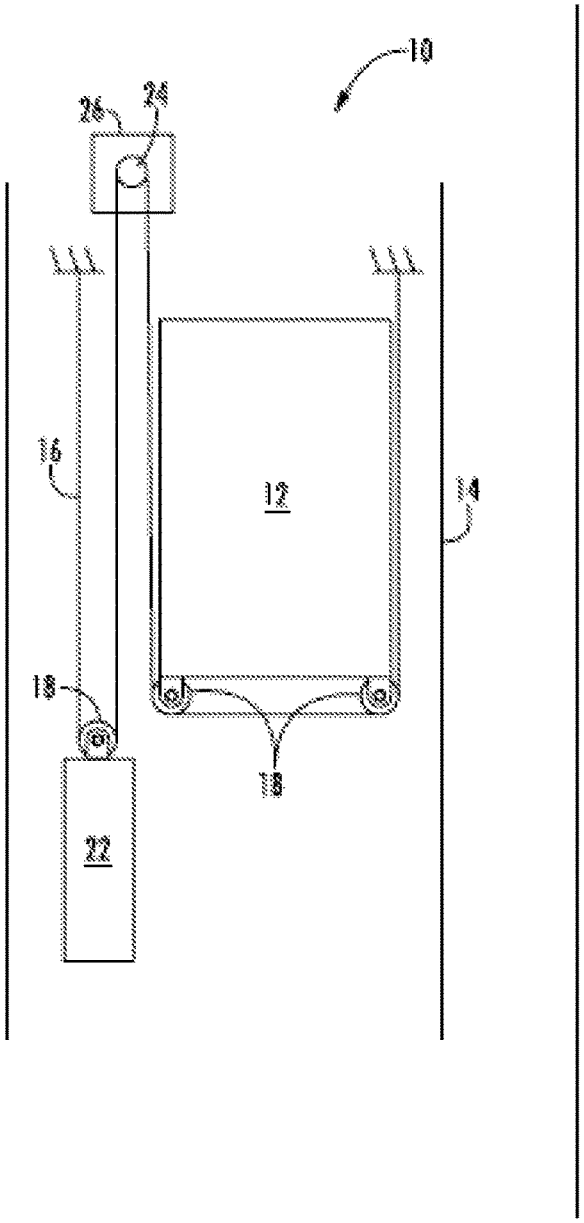
FIG. 1B is a schematic of another exemplary elevator system having a different roping arrangement.
Figure 1C:
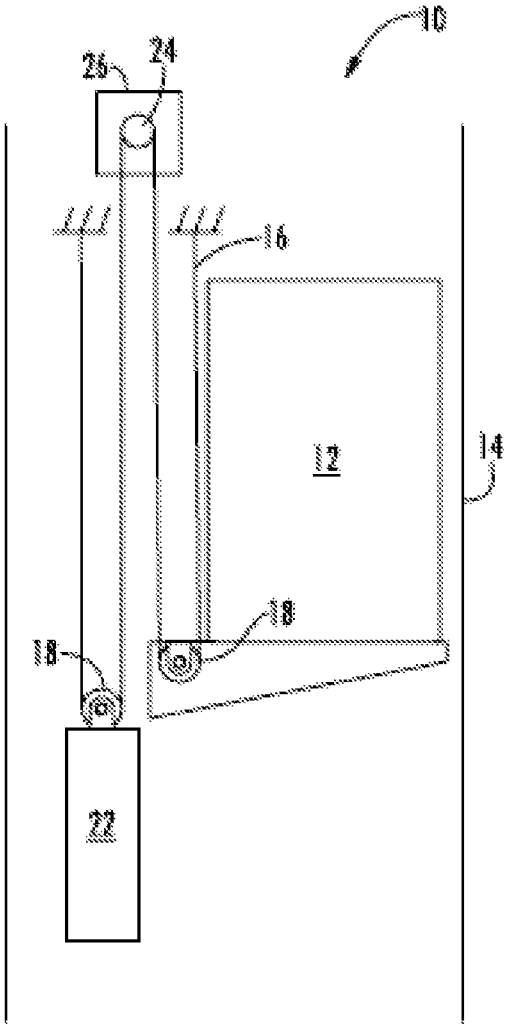
FIG. 1C is a schematic of another exemplary elevator system having a cantilevered arrangement.

Shown in FIGS. 1A, 1B and 1C are schematics of exemplary traction elevator systems 10. The elevator system 10 includes an elevator car 12 operatively suspended or supported in a hoistway 14 with one or more suspension members 16, such as ropes or belts. The one or more suspension members 16 interact with one or more sheaves 18 to be routed around various components of the elevator system 10. The one or more sheaves 16 could also be connected to a counterweight 22, which is used to help balance the elevator system 10 and reduce the difference in belt tension on both sides of a traction sheave 24 during operation.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of traction sheave 24 by the machine 26 drives, moves and/or propels (through traction) the one or more belts 16 that are routed around the traction sheave 24.

At least one of the sheaves 18 could be a diverter, deflector or idler sheave. Diverter, deflector or idler sheaves are not driven by the machine 26, but help guide the one or more suspension members 16 around the various components of the elevator system 10.

Referring again to FIG. 1A, the elevator system 10 further includes one or more guide rails 28 to guide the elevator car 12 along the hoistway 14. The elevator car includes one or more guide shoes 30 interactive with the guide rails 28 to guide the elevator car 12, and also may include safeties 32 interactive with the guide rail 28 to slow and/or stop motion of the elevator car 12 under certain conditions, such as an overspeed condition.

Figure 2:
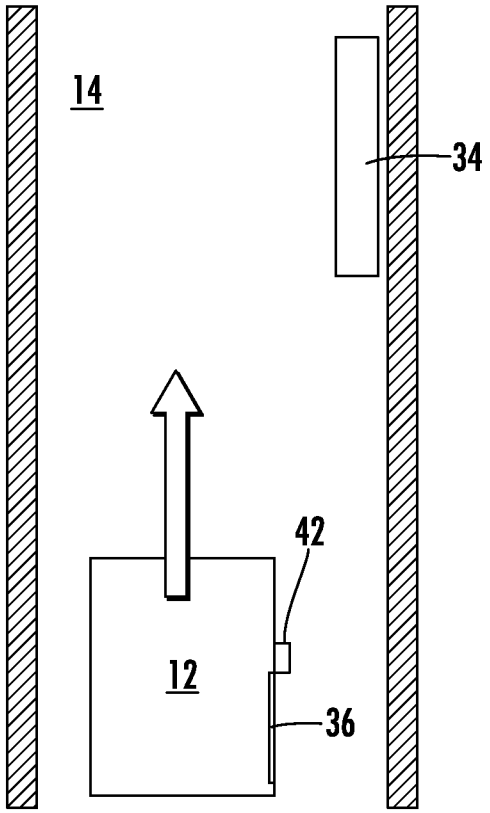
FIG. 2 is a schematic front or side view of an embodiment of an access door arrangement for an elevator system.
Figure 3:
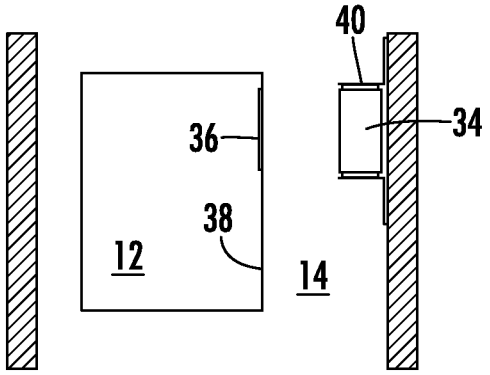
FIG. 3 is a schematic top view of an embodiment of an access door arrangement for an elevator system.

Referring now to FIGS. 2 and 3, the elevator system 10 includes one or more components, represented as cabinet 34, in the hoistway 14. The cabinet 34 may be, for example, a drive cabinet, electrical cabinet, lighting cabinet, machine, car and counterweight buffer, tension device or the like. Further, the cabinet 34 may represent a governor or other elevator system components located in the hoistway 14. It is to be appreciated that the listed components are merely exemplary and the present disclosure may be utilized in combination with any elevator system component located in the hoistway 14.

Figure 4:
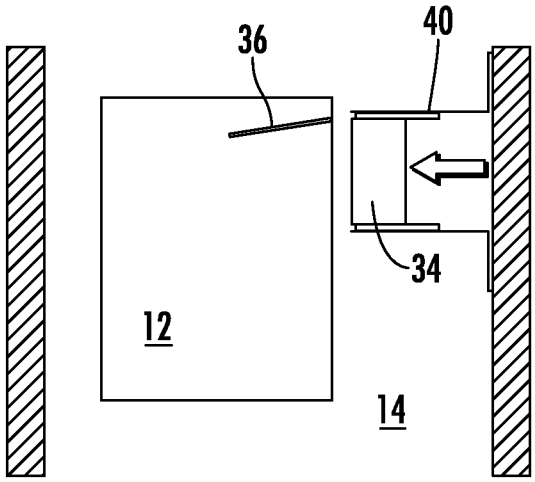
FIG. 4 is a schematic top view of another embodiment of an access door arrangement for an elevator system.

The elevator car 12 includes an access door 36 at, for example, a sidewall 38 of the elevator car 12. The access door 36 allows for access to the cabinet 34 from inside of the elevator car 12 for inspection, maintenance and/or repair operations at the cabinet 34, so a technician does not need to enter the hoistway 14 outside of the elevator car 12 to perform these operations. Referring now to FIG. 4, when the access door 36 is opened, a telescoping mechanism 40 of the cabinet 34 may be activated to move the cabinet 34 away from a hoistway wall 42 and toward or into the elevator car 12 to reduce the necessary reach for a technician to perform inspection, maintenance or repair operations at the cabinet 34.

Figure 5:
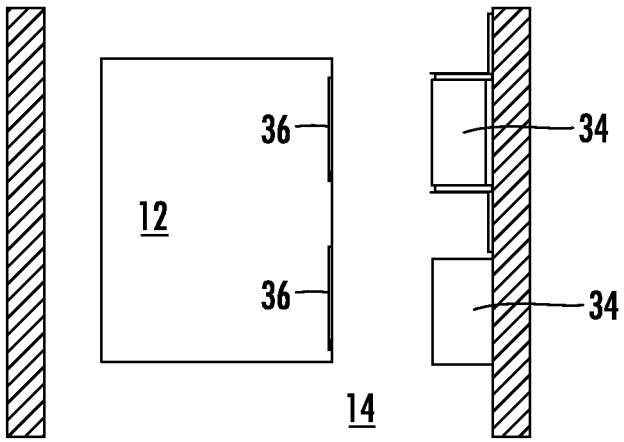
FIG. 5 is a schematic top view of yet another embodiment of an access door arrangement for an elevator system.

Referring now to FIG. 5, multiple cabinets 34 may be located in the hoistway 14, which may be accessed via the same access door 36 or alternatively by multiple access doors 36. In some embodiments, each cabinet 34 may be accessed by a unique, dedicated access door 36.

In operation, the elevator system 10 is switched from normal, passenger conveying, operation to a maintenance mode via, for example, a key switch in the elevator car 12 or a maintenance access combination with car operating panel buttons, located at, for example, a control panel of the elevator car 12. The elevator car 12 is then driven along the hoistway 14 to a location of a first cabinet 34. Once at the cabinet location, the access door 36 is unlocked via an automatic operation triggered by, for example, a sensor 42 (see FIG. 2), located at the elevator car 12 or on the component in the hoistway 14 and operably connected to the access door 36. The sensor 42 triggers opening of the access door 36 when the access door 36 is in proximity to the cabinet 34. In other embodiments, the access door 36 is unlocked and operated manually by the technician in the elevator car 12.

The telescoping mechanism 40 is then activated to move the cabinet 34 toward the elevator car 12. This operation happens either automatically when the access door 36 is opened or via a manual operation of, for example, a switch at the cabinet 34. The inspection, maintenance, or repair operation is then performed, and the access door 36 is closed once the operation is completed. The closure of the access door 36 may trigger automatic retraction of the telescoping mechanism 40, or alternatively the telescoping mechanism 40 may be retracted prior to closure of the access door 36.

In elevator systems 10 with more than one cabinet 34, the elevator car 12 is driven to a second cabinet 34 location and the access door 36 is opened as above. Alternatively a second, unique access door 36 is opened to access the second cabinet 36. The steps may be repeated for any additional cabinets 34 and/or components in the hoistway 14.

Use of the access door 36 and the telescoping mechanism 40 allows for maintenance operations at the cabinets 34 or other hoistway components to be performed from inside of the elevator car 12 rather than by a technician entering the hoistway 14 itself. This arrangement thus reduces instances where a service technician must enter the hoistway 14, improving technician safety and reducing or eliminating a safety volume needed in the hoistway for such operations. This in turn can reduce an overall volume of the elevator system 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator system comprising:

a hoistway;

one or more elevator system components fixed in the hoistway;

an elevator car suspended in the hoistway via a suspension member and drivable along the hoistway, the elevator car including an access door openable from inside the elevator car to provide access to the one or more elevator system components in the hoistway, such that inspection, maintenance and/or repair can be performed on the one or more elevator system components from inside of the elevator car; and a telescoping mechanism to urge the elevator system component toward the elevator car.

2. The elevator system of claim 1, wherein the one or more elevator system components are disposed at one or more cabinets fixed at a sidewall or rear wall of the hoistway.

3. The elevator system of claim 1, further comprising a sensor disposed at the elevator car or at a hoiswtway component level, the sensor operably connected to the access door to trigger opening of the access door when the elevator car is in proximity to the one or more elevator system components.

4. The elevator system of claim 1, wherein the one or more elevator system components include a drive cabinet, an electrical cabinet, a lighting cabinet, a machine, a car and counterweight buffer, a tension device and/or a governor.

5. A method of operating an elevator system comprising:

driving an elevator car along a hoistway;

stopping the elevator car in proximity to a first elevator system component disposed in the hoistway;

opening a first access door of the elevator car from inside of the elevator car to access the first elevator system component disposed outside of the elevator car; and urging the first elevator system component toward the elevator car via a telescoping mechanism.

6. The method of claim 5, further comprising performing inspection, maintenance and/or repair of the first elevator system component from inside of the elevator car.

7. The method of claim 5, further comprising, automatically urging the first elevator system component toward the elevator car when the first access door is opened.

8. The method of claim 5, further comprising retracting the telescoping mechanism to return the first elevator system component to its original position.

9. The method of claim 8, wherein the retraction occurs automatically with closure of the first access door.

10. The method of claim 5, further comprising:

driving the elevator car along the hoistway;

stopping the elevator car in proximity to a second elevator system component;

opening a second access door of the elevator car from inside of the elevator car to access the second elevator system component disposed outside of the elevator car.

11. The method of claim 10, further comprising performing inspection, maintenance and/or repair of the second elevator system component from inside of the elevator car.

* * * * *